US006557499B2

(12) United States Patent
Franke et al.

(10) Patent No.: US 6,557,499 B2
(45) Date of Patent: May 6, 2003

(54) FOSSIL-FUEL-FIRED ONCE-THROUGH STEAM GENERATOR

(75) Inventors: Joachim Franke, Altdorf (DE); Rudolf Kral, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 63 days.

(21) Appl. No.: 09/734,461

(22) Filed: Dec. 11, 2000

(65) Prior Publication Data

US 2002/0157618 A1 Oct. 31, 2002

Related U.S. Application Data

(63) Continuation of application No. PCT/DE99/01550, filed on May 26, 1999.

(30) Foreign Application Priority Data

Jun. 10, 1998 (DE) ..... 198 25 800
Nov. 11, 1998 (DE) ..... 198 51 809

(51) Int. Cl.[7] ..... F22B 33/00

(52) U.S. Cl. ..... 122/1 B; 122/7 R; 122/235.12; 122/406.4; 122/DIG. 4

(58) Field of Search ..... 122/1 B, 451 S, 122/235.12, 479.7, 406.4, DIG. 4, 7 R

(56) References Cited

U.S. PATENT DOCUMENTS

| | | | | |
|---|---|---|---|---|
| 3,003,479 A | * | 10/1961 | Bock et al. | 122/1 B |
| 3,043,279 A | | 7/1962 | Blomquist | |
| 3,136,298 A | | 6/1964 | Frendberg et al. | |
| 3,527,261 A | | 9/1970 | Bigler et al. | |
| 3,741,174 A | * | 6/1973 | Rudd et al. | 122/510 |
| 3,973,523 A | | 8/1976 | Keller et al. | |
| 4,987,862 A | * | 1/1991 | Wittchow et al. | 122/6 A |
| 5,560,322 A | * | 10/1996 | Fitzgerald | 122/64 |
| 5,662,070 A | * | 9/1997 | Kastner et al. | 122/6 A |

FOREIGN PATENT DOCUMENTS

| | | |
|---|---|---|
| AT | 376 026 | 10/1984 |
| DE | 1 086 382 | 8/1960 |
| DE | 27 34 031 A1 | 2/1979 |
| DE | 42 27 457 A1 | 2/1994 |
| DE | 44 31 185 A1 | 3/1996 |
| EP | 0 450 072 A1 | 10/1991 |
| FR | 1 154 150 | 4/1958 |

* cited by examiner

*Primary Examiner*—Jiping Lu
(74) *Attorney, Agent, or Firm*—Laurence A. Greenberg; Werner H. Stemer; Ralph E. Locher

(57) ABSTRACT

The steam generator has a combustion chamber for fossil fuel. A vertical gas flue is arranged downstream of the combustion chamber on a heating-gas side and connected via a horizontal gas flue. The structure requires especially little outlay in terms of manufacture and installation. The combustion chamber has a number of burners which are disposed at the same level with the horizontal gas flue.

14 Claims, 3 Drawing Sheets

FOSSIL-FUEL-FIRED ONCE-THROUGH STEAM GENERATOR

CROSS-REFERENCE TO RELATED APPLICATION

This application is a continuation of copending International Application No. PCT/DE99/01550, filed May 26, 1999, which designated the United States.

BACKGROUND OF THE INVENTION

Field of the Invention

The invention relates to a steam generator having a combustion chamber for fossil fuel, downstream of which a vertical gas flue is arranged on the heating-gas side via a horizontal gas flue.

Steam generators are normally used to evaporate a flow medium, for example a water-water/steam mixture, conducted in an evaporator circuit. To this end, the steam generator has evaporator tubes, the heating of which leads to the evaporation of the flow medium conducted therein.

Steam generators are normally constructed with a combustion chamber in an upright type of construction. This means that the combustion chamber for a throughflow of the heating medium or heating gas is designed in an approximately vertical direction. A horizontal gas flue may thereby be arranged downstream of the combustion chamber on the heating-gas side. The heating-gas flow is deflected into an approximately horizontal flow direction at the transition from the combustion chamber to the horizontal gas flue. However, the upright type of construction of the combustion chamber, on account of the temperature-induced changes in length of the combustion chamber, i.e., the heat expansion, requires a framework on which the combustion chamber is suspended. This requires considerable technical outlay during the manufacture and installation of the steam generator. This technical outlay is all the greater, the greater the overall height of the steam generator is.

SUMMARY OF THE INVENTION

The object of the invention is to provide a fossil-fuel-fired steam generator which overcomes the above-noted deficiencies and disadvantages of the prior art devices and methods of this kind, and which requires especially little outlay in terms of manufacture and installation.

With the above and other objects in view there is provided, in accordance with the invention, a once-through steam generator, comprising:

- a combustion chamber for combusting a fossil fuel;
- a horizontal gas flue communicating with the combustion chamber on a heating-gas side thereof;
- a vertical gas flue communicating with the combustion chamber via the horizontal gas flue; and
- a plurality of burners disposed to combust the fossil fuel in the combustion chamber at a level of the horizontal gas flue.

The invention is based on the recognition that a steam generator which can be constructed with especially little outlay in terms of manufacture and installation should have a holding structure which can be constructed with simple means. In this case, a framework, which is to be constructed with comparatively little technical outlay, for the suspension of the combustion chamber can be accompanied by an especially low overall height of the steam generator. An especially low overall height of the steam generator can be achieved by the combustion chamber being given a horizontal type of construction. To this end, the burners are arranged at the level of the horizontal gas flue in the combustion-chamber wall. The heating gas therefore flows through the combustion chamber in an approximately horizontal direction during operation of the steam generator.

The burners are advantageously arranged on the end face of the combustion chamber, that is on that side wall of the combustion chamber which is opposite the outflow opening to the horizontal gas flue. A steam generator of such design can be adapted to the burn-out length of the fuel in an especially simple manner. Burn-out length of the fuel in this case refers to the flue-gas velocity in the horizontal direction at a certain average flue-gas temperature multiplied by the burn-out time $t_A$ of the fuel. In this case, the maximum burn-out length for the respective steam generator is obtained during full-load operation of the steam generator. The burn-out time $t_A$ is in turn the time which, for example, a pulverized-coal grain of average size requires in order to burn out completely at a certain average flue-gas temperature.

In order to keep material damage and undesirable contamination of the horizontal gas flue, for example on account of ash deposit, at an especially low level, the length of the combustion chamber, which is defined by the distance from the end face to the inlet region of the horizontal gas flue, is advantageously at least equal to the burn-out length of the fuel during full-load operation of the steam generator.

In accordance with an added feature of the invention, the length L (specified in m) of the combustion chamber is selected as a function of the BMCR value W (specified in kg/s) of the combustion chamber, the burn-out time $t_A$ (specified in seconds s) of the fuel and the outlet temperature $T_{BRK}$ (specified in ° C.) of the working medium from the combustion chamber. BMCR stands for boiler maximum continuous rating, and the BMCR value is the term normally used internationally for the maximum continuous output of a steam generator. This also corresponds to the design output, that is the output during full-load operation of the steam generator. In this case, at a given BMCR value W, the length L of the combustion chamber is approximately the larger value of the functions:

$$L(W, t_A)=(C_1+C_2\cdot W)\cdot t_A \text{ and}$$

$$L(W, T_{BRK})=(C_3\cdot T_{BRK}+C_4)W+C_5(T_{BRK})^2+C_6\cdot T_{BRK}+C_7$$

where $C_1$=8 m/s $C_2$=0.0057 m/kg $C_3=-1.905\cdot 10^{-4}$ (m·s)/(kg° C.)

$C_4$=0.2857 (s·m)/kg $C_5=3\cdot 10^{-4}$ m/(° C.)$^2$ $C_6$=−0.8421 m/° C.

$C_7$=603.4125 m.

In this case, the terms "approximately" or "substantially" are to be understood as allowing an admissible deviation by +20%/−10% from the value defined by the respective function.

The end face of the combustion chamber and the side walls of the combustion chamber, of the horizontal gas flue and/or of the vertical gas flue are advantageously formed from vertically arranged evaporator or steam-generator tubes which are welded to one another in a gastight manner and to which in each case flow medium can be admitted in a parallel manner.

For especially good heat transfer of the heat of the combustion chamber to the flow medium conducted in the evaporator tubes, a number of evaporator tubes, on their inside, in each case advantageously have ribs forming a multi-start thread. In this case, a helix angle $\alpha$ between a plane perpendicular to the tube axis and the flanks of the ribs arranged on the tube inside is advantageously less than 60°, preferably less than 55°. This is because, in a heated evaporator tube designed as an evaporator tube without inner ribbing, a so-called smooth tube, the wetting of the tube wall can no longer be maintained starting from a certain steam content. If there is a lack of wetting, there may be a tube wall which is dry in places. The transition to such a dry tube wall, in a type of critical stage of the heat transfer, results in an especially restricted heat-transfer behavior, so that in general the tube-wall temperatures at this location increase to an especially pronounced extent. In an inner-ribbed tube, however, this critical stage of the heat transfer, compared with a smooth tube, does not occur until there is a steam mass content >0.9, that is just before the end of the evaporation. This may be attributed to the swirl which the flow undergoes due to the spiral-shaped ribs. On account of their different centrifugal forces, the water portion is separated from the steam portion and forced onto the tube wall. As a result, the wetting of the tube wall is maintained up to high steam contents, so that there are already high flow velocities at the location of the heat-transfer critical stage. This produces especially good heat transfer and consequently low tube-wall temperatures.

In accordance with an advantageous feature of the invention, adjacent evaporator or steam-generator tubes are welded to one another in a gastight manner via metal bands, so-called fins. The fin width influences the heat input into the steam-generator tubes. The fin width is therefore preferably adapted as a function of the position of the respective evaporator or steam-generator tubes in the steam generator to a temperature profile which can be predetermined on the gas side. In this case, the predetermined temperature profile may be a typical temperature profile determined from empirical values or also a rough estimation, such as a stepped profile for example. Due to the suitably selected fin widths, heat input into all the evaporator or steam-generator tubes, even during highly inhomogeneous heating of the various evaporator or steam-generator tubes, can be achieved in such a way that temperature differences at the outlet of the evaporator or steam-generator tubes can be kept especially small. In this way, premature material fatigue is reliably prevented. As a result, the steam generator has an especially long service life.

In accordance with a further advantageous refinement of the invention, the inner tube diameter of the evaporator tubes of the combustion chamber is selected as a function of the respective position of the evaporator tubes in the combustion chamber. In this way, the evaporator tubes in the combustion chamber can be adapted to a temperature profile which can be predetermined on the gas side. With the effect which this has on the flow through the evaporator tubes, temperature differences at the outlet of the evaporator tubes of the combustion chamber are kept small in an especially reliable manner.

A common inlet-collector system is connected upstream of the evaporator tubes of the combustion chamber for the flow medium, and a common outlet-collector system is connected downstream of said evaporator tubes. A steam generator in this embodiment permits a reliable pressure balance between the evaporator tubes connected in parallel and thus permits an especially uniform flow through the same.

The evaporator tubes of the end face of the combustion chamber are advantageously connected on the flow-medium side upstream of the evaporator tubes of the side walls of the combustion chamber. As a result, especially favorable utilization of the heat of the burners is ensured.

A number of superheater heating surfaces which are arranged approximately perpendicularly to the main flow direction of the heating gas, and the tubes of which are connected in parallel for a throughflow of the flow medium, are advantageously arranged in the horizontal gas flue. These superheater heating surfaces, which are arranged in a suspended type of construction and are also designated as bulkhead heating surfaces, are mainly heated in a convective manner and are connected on the flow-medium side downstream of the evaporator tubes of the combustion chamber. As a result, especially favorable utilization of the burner heat is ensured.

In accordance with again an added feature of the invention, the vertical gas flue has a number of convection heating surfaces which are formed from tubes arranged approximately perpendicularly to the main flow direction of the heating gas. These tubes are connected in parallel for a throughflow of the flow medium. These convection heating surfaces are also mainly heated in a convective manner.

In order to also ensure especially complete utilization of the heat of the heating gas, the vertical gas flue advantageously has an economizer or high-pressure preheater.

The advantages achieved by the invention consist in particular in the fact that an especially low overall height of the steam generator can be achieved by the arrangement of the burners at the level of the horizontal gas flue. Thus the integration of the steam generator in a steam-turbine plant also permits especially short connecting pipes from the steam generator to the steam turbine. The steam generator has an especially compact type of construction due to the design of the combustion chamber for a throughflow of the heating gas in an approximately horizontal direction. In this case, the length of the combustion chamber is designed in such a way that especially good utilization of the heat of the fossil fuel is ensured.

Other features which are considered as characteristic for the invention are set forth in the appended claims.

Although the invention is illustrated and described herein as embodied in a fossil-fuel-fired steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Like parts and functionally identical components are identified with the same reference numerals throughout the figures.

DESCRIPTION OF THE PREFERRED EMBODIMENTS

Figure 1:
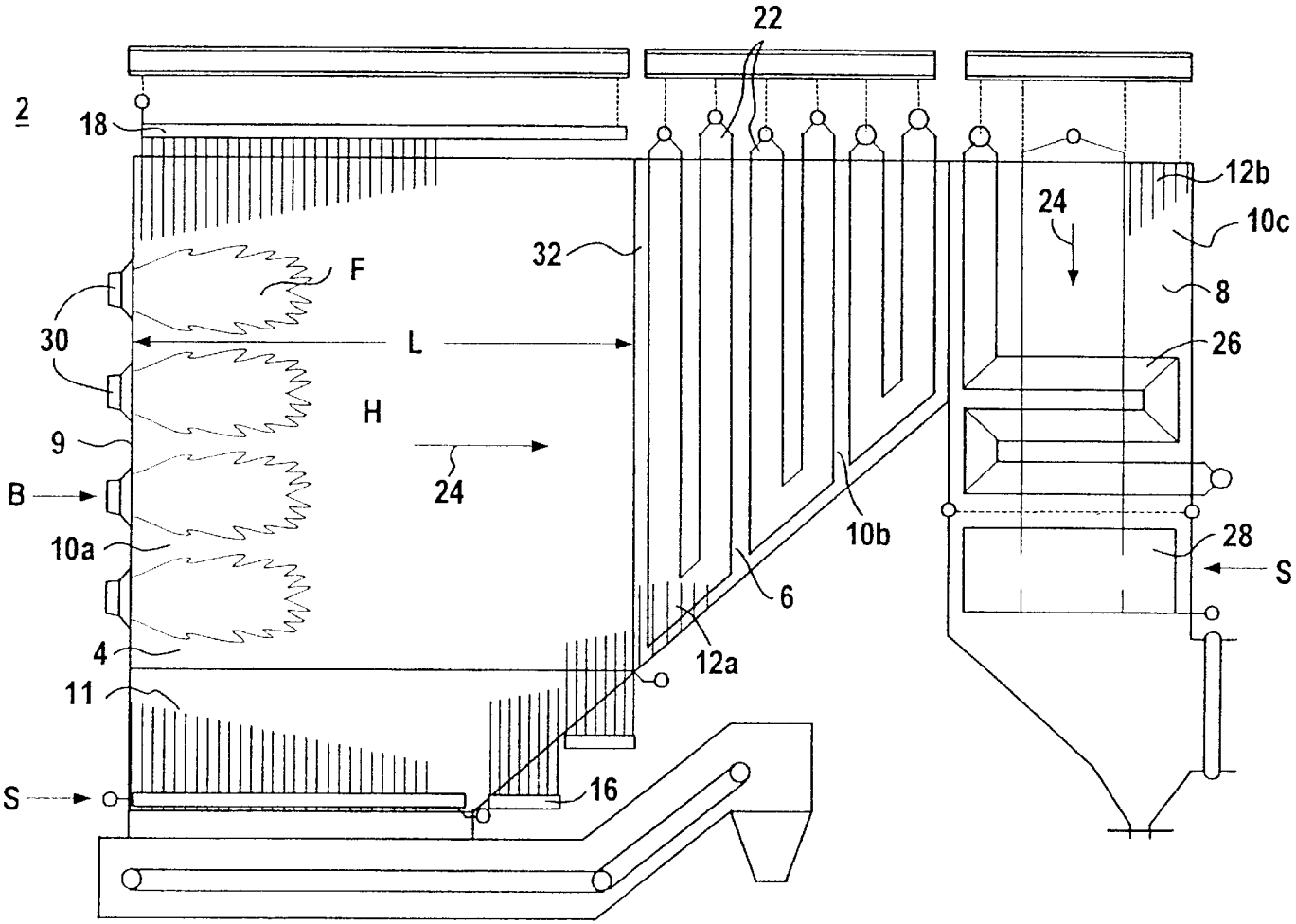
FIG. 1 is a schematic side view of a fossil-fuel-fired steam generator in a twin-flue type of construction.

Referring now to the figures of the drawing in detail and first, particularly, to FIG. 1 thereof, there is seen a fossil-fuel-fired steam generator 2 given a horizontal type of construction. The exemplary embodiment is a once-through steam generator. It comprises a combustion chamber 4, downstream of which a vertical gas flue 8 is connected on the heating-gas side via a horizontal gas flue 6. An end face 9 and side walls 10*a* of the combustion chamber 4 are formed from vertically arranged evaporator tubes 11 which are welded to one another in a gastight manner and to which flow medium S can be admitted in parallel flow. In addition, side walls 10*b* of the horizontal gas flue 6 and 10*c* of the vertical gas flue 8 may also be formed from vertically arranged steam-generator tubes 12*a* and 12*b*, respectively, welded to one another in a gastight manner. In this case, flow medium S can likewise be admitted in a parallel manner to the respective steam-generator tubes 12*a*, 12*b*.

Figure 2:
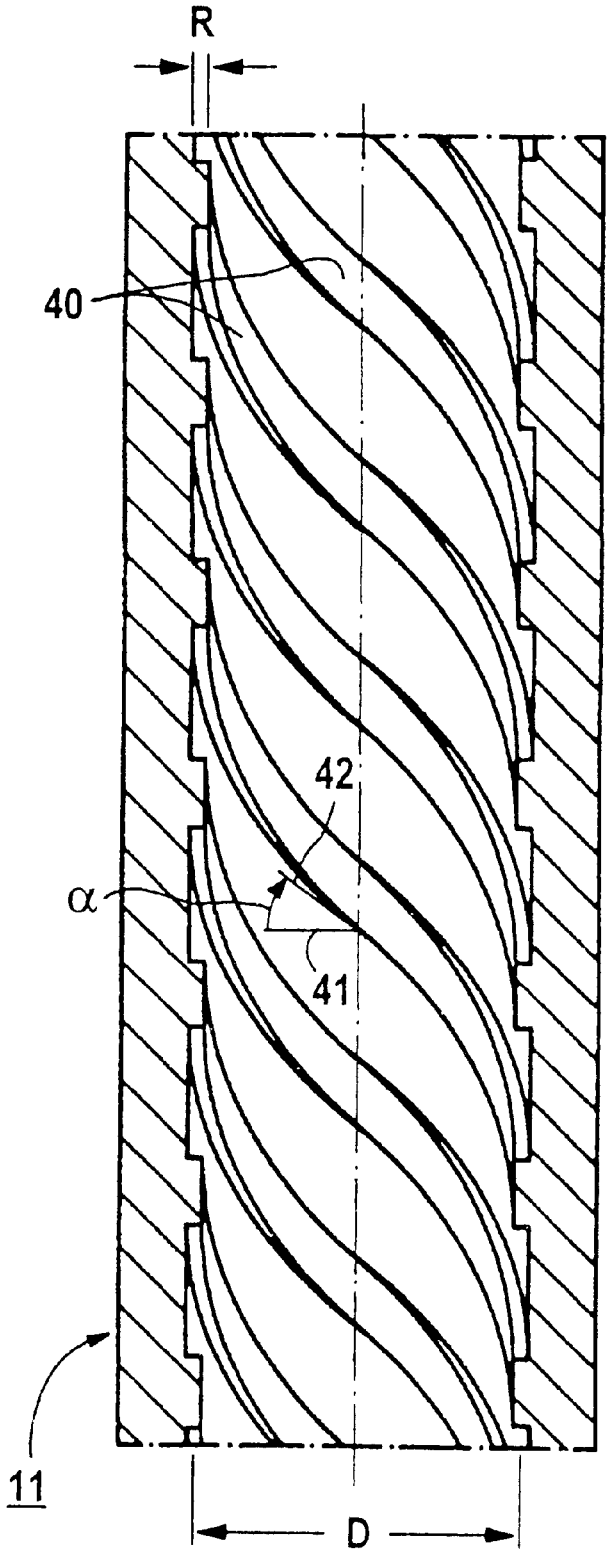
FIG. 2 is a schematic longitudinal section taken through an individual evaporator or steam-generator tube.

With reference to FIG. 2, the evaporator tubes 11 have ribs 40 on their inside which form a type of multi-start thread and have a rib height R. The helix angle $\alpha$ between a plane 41 perpendicular to the tube axis and the flanks 42 of the ribs 40 that are formed on the tube inside is less than 55°. As a result, especially high heat transfer of the heat of the combustion chamber 4 to the flow medium S conducted in the evaporator tubes 11 with at the same time especially low temperatures of the tube wall is achieved.

Adjacent evaporator or steam-generator tubes 11, 12*a*, 12*b* are welded to one another in a gastight manner via fins in a manner not shown in any more detail in FIG. 1. This is because the heating of the evaporator or steam-generator tubes 11, 12*a*, 12*b* can be influenced by a suitable selection of the fin width. The respective fin width is therefore adapted as a function of the position of the respective evaporator or steam-generator tubes 11, 12*a*, 12*b* in the steam generator to a temperature profile which can be predetermined on the gas side. In this case, the temperature profile may be a typical temperature profile determined from empirical values or also a rough estimation. As a result, temperature differences at the outlet of the evaporator or steam-generator tubes 11, 12*a*, 12*b* are kept especially small even when the heating of the evaporator or steam-generator tubes 11, 12*a*, 12*b* varies greatly. In this way, material fatigue is reliably prevented, which ensures a long service life of the steam generator 2.

An inner tube diameter D of the evaporator tubes 11 of the combustion chamber 4 is selected as a function of the respective position of the evaporator tubes 11 in the combustion chamber 4. In this way, the steam generator 2 is additionally adapted to the varying intensity of the heating of the evaporator tubes 11. This design of the evaporator tubes 11 of the combustion chamber 4 ensures, in an especially reliable manner, flow through the evaporator tubes 11 in such a way that temperature differences at the outlet of the evaporator tubes 11 are kept especially small.

In the case of the tubing of the combustion chamber, it is to be taken into account that the heating of the individual evaporator tubes 11 welded to one another in a gastight manner varies greatly during operation of the steam generator 2. The design of the evaporator tubes 11 with regard to their inner ribbing, fin connection to adjacent evaporator tubes 11, and their inner tube diameter D is therefore selected in such a way that all the evaporator tubes 11, despite different heating, have approximately the same outlet temperature, and adequate cooling of the evaporator tubes 11 for all the operating states of the steam generator 2 is ensured. This is ensured in particular owing to the fact that the steam generator 2 is designed for a comparatively low mass flow density of the flow medium S flowing through the evaporator tubes 11. In addition, a suitable selection of the fin connections and the inner tube diameter D achieves the effect that the proportion of the friction pressure loss to the total pressure loss is so low that natural circulation behavior occurs: the flow through the evaporator tubes 11 heated to a greater degree is greater than the flow through the evaporator tubes 11 that are heated to a lesser degree. This achieves the effect that the evaporator tubes 11 in the vicinity of the burners—these evaporator tubes 11 are heated to a comparatively high degree—specifically absorb approximately just as much heat, relative to the mass flow, as the evaporator tubes 11 at the combustion-chamber end, which are heated to a comparatively low degree. In this case, the inner ribbing is designed in such a way that adequate cooling of the evaporator-tube walls is ensured. Thus, with the above-mentioned measures, all the evaporator tubes 11 have approximately the same outlet temperature. For a steam generator with a vertical gas flue, such an evaporator concept has been disclosed, for example, by VGB-Kraftwerkstechnik 75 (1995), No. 4, pages 353–59.

On the flow-medium side, an inlet-collector system 16 for flow medium S is connected upstream of the evaporator tubes 11 of the combustion chamber 4 and an outlet-collector system 18 is connected downstream of the evaporator tubes 11. As a result, a pressure balance of the evaporator tubes 11 connected in parallel is possible. The pressure balance produces a uniform flow through the same.

In order to achieve especially good utilization of the combustion heat of the fossil fuel B, the evaporator tubes 11 of the end face 9 of the combustion chamber 4 are connected upstream of the evaporator tubes 11 of the side walls 10*a* of the combustion chamber 4 on the flow-medium side.

The horizontal gas flue 6 has a plurality of superheater heating surfaces 22 which are designed as bulkhead heating surfaces, are arranged in a suspended type of construction approximately perpendicularly to the main flow direction 24 of the heating gas H, and the tubes of which are connected in parallel for a throughflow of the flow medium S. The superheater heating surfaces 22 are mainly heated in a convective manner (convection heating) and are connected on the flow-medium side downstream of the evaporator tubes 11 of the combustion chamber 4.

The vertical gas flue 8 has a number of convection heating surfaces 26 which can be heated mainly in a convective manner and are formed from tubes arranged approximately perpendicularly to the main flow direction of the heating gas H. These tubes are connected in parallel for a throughflow of the flow medium S. In addition, a high-pressure preheater or economizer 28 is arranged in the vertical gas flue 8. On the outlet side, the vertical gas flue 8 leads into a flue-gas or heat exchanger (not shown in any more detail) and from there into a stack via a dust filter.

The steam generator 2 is given a horizontal type of construction with an especially low overall height and can thus be set up with especially little outlay in terms of manufacture and installation. To this end, the combustion chamber 4 of the steam generator 2 has a number of burners 30 for fossil fuel B which are arranged at the end face 14 of the combustion chamber 4 at the level of the horizontal gas flue 6.

So that especially complete burn-out of the fossil fuel B is brought about in order to achieve an especially high efficiency, and so that material damage of the first superheater heating surface, as viewed from the heating-gas side, of the horizontal gas flue 6 and contamination of the same, for example due to ash deposit, are prevented in an especially reliable manner, the length L of the combustion chamber 4 is selected in such a way that it exceeds the burn-out length of the fuel B during full-load operation of the steam generator 2. The length L in this case is the distance from the end face 14 of the combustion chamber 4 to the inlet region 32 of the horizontal gas flue 6. In this case, the burn-out length of the fuel B is defined as the hot-gas velocity in the horizontal direction at a certain average flue-gas temperature multiplied by the burn-out time $t_A$ of the fuel B. The maximum burn-out length for the respective steam generator 2 is obtained during full-load operation of the steam generator 2. The burn-out time $t_A$ of the fuel B is in turn the time which, for example, a pulverized-coal grain of average size requires for complete burn-out at a certain average flue-gas temperature.

In order to ensure especially favorable utilization of the combustion heat of the fossil fuel B, the length L (specified in m) of the combustion chamber 4 is suitably selected in dependence on an outlet temperature $T_{BRK}$ (specified in ° C.) of the working medium from the combustion chamber 4, the burn-out time $t_A$ (specified in s) of the fuel B, and the BMCR value W (specified in kg/s) of the combustion chamber 4. The term BMCR stands for boiler maximum continuous rating. The BMCR value W is a term normally used internationally for the maximum continuous output of a steam generator. This also corresponds to the design output, that is the output during full-load operation of the steam generator. In this case, the length L of the combustion chamber 4 is approximately determined via the functions $$L(W, t_A)=(C_1+C_2\cdot W)\cdot t_A \quad (1)$$

$$L(W, T_{BRK})=(C_3\cdot T_{BRK}+C_4)W+C_5(T_{BRK})^2+C_6\cdot T_{BRK}+C_7 \quad (2)$$

where $C_1$=8 m/s $C_2$=0.0057 m/kg $C_3=-1.905\cdot 10^{-4}$ (m·s)/(kg° C.)

$C_4$=0.2857 (s·m)/kg $C_5=3\cdot 10^{-4}$ m/(° C.)$^2$ $C_6$=−0.8421 m/° C.

$C_7$=603.4125 m.

The terms "approximately" and "substantially" in this case are to be understood as admitting of a deviation by +20%/−10% from the value defined by the respective function. In this case, for any desired but fixed BMCR value of the combustion chamber 4, the larger value of the values L of the length L of the combustion chamber 4 always applies.

Figure 3:
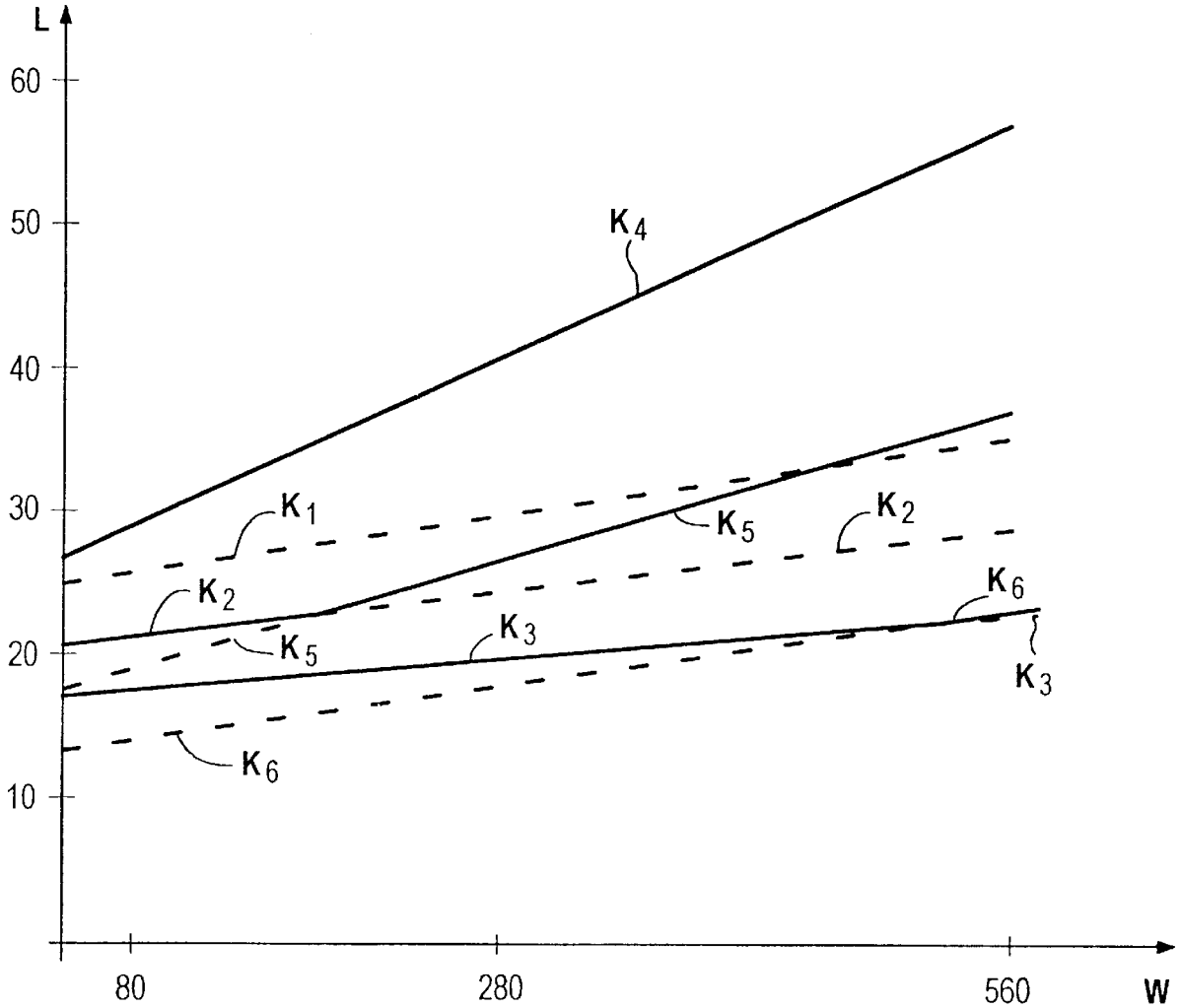
FIG. 3 is a graph with a coordinate system showing curves $K_1$ to $K_6$.

As an example for a calculation of the length L of the combustion chamber 4 as a function of the BMCR value W, six curves $K_1$ to $K_6$ are plotted in the coordinate system according to FIG. 3. In this case, the following parameters are assigned to the respective curves:

$K_1$: $t_A$=3 s according to (1), $K_2$: $t_A$=2.5 s according to (1), $K_3$: $t_A$=2 s according to (1), $K_4$: $T_{BRK}$=1200° C. according to (2), $K_5$: $T_{BRK}$=1300° C. according to (2) and $K_6$: $T_{BRK}$=1400° C. according to (2).

To determine the length L of the combustion chamber 4, the curves $K_1$ and $K_4$ are therefore to be used, for example, for a burn-out time $t_A$=3 s and an outlet temperature $T_{BRK}$=1200° C. of the working medium from the combustion chamber 4. From this, at a predetermined BMCR value W of the combustion chamber 4, the length is derived as L=29 m according to $K_4$ at a value of W=80 kg/s, L=34 m according to $K_4$ at a value of W=160 kg/s, L=57 m according to $K_4$ at a value of W=560 kg/s.

The curves $K_2$ and $K_5$, for example, are to be used for the burn-out time $t_A$=2.5 s and the outlet temperature $T_{BRK}$ of the working medium from the combustion chamber=1300° C. From this, at a predetermined BMCR value W of the combustion chamber 4, the length is derived as L=21 m according to $K_2$ at a value of W=80 kg/s, L=23 m according to $K_2$ and $K_5$ at a value of W=180 kg/s, L=37 m according to $K_5$ at a value of W=560 kg/s.

The curves $K_3$ and $K_6$, for example, are devoted to the burn-out time $t_A$=2 s and the outlet temperature $T_{BRK}$ of the working medium from the combustion chamber=1400° C. From this, at a predetermined BMCR value W of the combustion chamber 4, the length is derived as L=18 m according to $K_3$ at a value of W=80 kg/s, L=21 m according to $K_3$ and $K_6$ at a value of W=465 kg/s, L=23 m according to $K_6$ at a value of W=560 kg/s.

During the operation of the steam generator 2, fossil fuel B is supplied to the burners 30. In this case, the flames F of the burners 30 are oriented horizontally. Due to the type of construction of the combustion chamber 4, a flow of the heating gas H produced during the combustion is produced in an approximately horizontal main flow direction 24. The heating gas H passes via the horizontal gas flue 6 into the vertical gas flue 8, oriented approximately toward the base, and leaves the latter in the direction of the stack (not shown in any more detail).

Flow medium S entering the economizer 28 passes via the convection heating surfaces arranged in the vertical gas flue 8 into the inlet-collector system 16 of the combustion chamber 4 of the steam generator 2. The evaporation, and if need be partial superheating, of the flow medium S take place in the vertically arranged evaporator tubes 11, welded to one another in a gastight manner, of the combustion chamber 4 of the steam generator 2. The steam produced in the process, or a water/steam mixture, is collected in the outlet-collector system 18 for flow medium S. From there, the steam or the water/steam mixture passes into the walls of the horizontal gas flue 6 and of the vertical gas flue 8 and from there in turn into the superheater heating surfaces 22 of the horizontal gas flue 6. Further superheating of the steam is effected in the superheater heating surfaces 22, and the steam is then supplied for utilization, for example for driving a steam turbine.

Especially little outlay in terms of manufacture and installation of the steam generator 2 is ensured by the especially low overall height and compact type of construction of the steam generator 2. A framework which can be constructed with comparatively little technical outlay is ensured in particular by the burners 30 of the combustion chamber 4, which are arranged at the level of the horizontal gas flue 6 and produce a flow through the combustion chamber 4 in an approximately horizontal main flow direction 24. In this case, by selecting the length L of the combustion chamber 4 as a function of the BMCR value of the combustion chamber 4, it is ensured that the combustion heat of the fossil fuel B is utilized in an especially reliable manner. In addition, in a steam-turbine plant having the steam generator 2 with such a low overall height, the connecting pipes from the steam generator 2 to the steam turbine may be designed to be especially short.

We claim:

1. A once-through steam generator, comprising:

a combustion chamber for combusting a fossil fuel;

a horizontal gas flue communicating with said combustion chamber on a heating-gas side thereof, said horizontal gas flue having side walls formed by vertically arranged steam-generator tubes welded to one another in a gastight manner and configured to receive flow medium in a parallel flow;

a vertical gas flue communicating with said combustion chamber via said horizontal gas flue; and a plurality of burners disposed to combust the fossil fuel in said combustion chamber at a level of said horizontal gas flue.

2. A once-through steam generator, comprising:

a combustion chamber for combusting a fossil fuel, said combustion chamber having an end face;

a horizontal gas flue communicating with said combustion chamber on a heating-gas side thereof, said horizontal gas flue having an inlet region;

a vertical gas flue communicating with said combustion chamber via said horizontal gas flue;

a plurality of burners disposed on said end face to combust the fossil fuel in said combustion chamber at a level of said horizontal gas flue;

said combustion chamber having a length defined by a distance from said end face to said inlet region of said horizontal gas flue, and said length is at least equal to a burn-out length of the fuel during full-load operation of the once-through steam generator; and said length of said combustion chamber being selected in dependence on a boiler maximum continuous rating (BMCR) value (W) of said combustion chamber, a burn-out time ($t_A$) of the fuel, and an outlet temperature ($T_{BRK}$) of a working medium from said combustion chamber approximately according to the following:

$$L(W, t_A)=(C_1+C_2\cdot W)\cdot t_A$$

$$L(W, T_{BRK})=(C_3\cdot T_{BRK}+C_4)W+C_5(T_{BRK})^2+C_6\cdot T_{BRK}+C_7$$

where $C_1$=8 m/s $C_2$=0.0057 m/kg $C_3=-1.905\cdot 10^{-4}$ (m·s)/(kg° C.)

$C_4$=0.2857 (s·m)/kg $C_5=3\cdot 10^{-4}$ m/(° C.)$^2$ $C_6$=−0.8421 m/° C.

$C_7$=603.4125 m;

wherein, for a BMCR value of said combustion chamber, the respectively larger value of said length of said combustion chamber applies.

3. The once-through steam generator according to claim 2, wherein said end face of said combustion chamber is formed of vertically arranged evaporator tubes welded to one another in a gastight manner and configured to receive a flow medium in a parallel flow.

4. The once-through steam generator according to claim 2, wherein said combustion chamber is formed with side walls formed of vertically arranged evaporator tubes welded to one another in a gastight manner and configured to receive a flow medium in a parallel flow.

5. The once-through steam generator according to claim 4, wherein a plurality of said evaporator tubes are formed with ribs on an inside thereof, said ribs defining a multi-start thread.

6. The once-through steam generator according to claim 5, wherein a helix angle enclosed between a plane perpendicular to a tube axis and flanks of said ribs is less than 60°.

7. The once-through steam generator according to claim 5, wherein a helix angle enclosed between a plane perpendicular to a tube axis and flanks of said ribs is less than 55°.

8. The once-through steam generator according to claim 2, wherein said vertical gas flue has side walls formed by vertically arranged steam-generator tubes welded to one another in a gastight manner and configured to receive flow medium in a parallel flow.

9. The once-through steam generator according to claim 2, which comprises a plurality of mutually adjacent evaporator and steam-generator tubes welded to one another in a gastight manner via fins, a fin width being selected in dependence on a respective position of said evaporator or steam-generator tubes in one of said combustion chamber, said horizontal gas flue, and said vertical gas flue.

10. The once-through steam generator according to claim 2, which comprises a plurality of evaporator tubes bounding said combustion chamber, said evaporator tubes having an inner tube diameter selected as a function of a position of a respective said evaporator tube in said combustion chamber.

11. The once-through steam generator according to claim 10, which comprises a common inlet-collector system for flow medium connected on a flow-medium side upstream of said evaporator tubes assigned to said combustion chamber, and a common outlet-collector system connected downstream of said evaporator tubes in a flow medium flow direction.

12. The once-through steam generator according to claim 10, wherein respective said evaporator tubes forming an end face of said combustion chamber are connected on a flow-medium side upstream of respective said evaporator tubes forming side walls of said combustion chamber.

13. The once-through steam generator according to claim 2, which comprises a plurality of superheater heating surfaces suspended in said horizontal gas flue.

14. The once-through steam generator according to claim 2, which comprises a plurality of convection heating surfaces disposed in said vertical gas flue.

* * * * *